United States Patent [19]

Wood et al.

[11] 4,089,457

[45] May 16, 1978

[54] PACKAGING INSERT

[75] Inventors: Prentice J. Wood, Hapeville; Robert E. Plaxico, Lithonia, both of Ga.

[73] Assignee: The Mead Corporation, Dayton, Ohio

[21] Appl. No.: 813,336

[22] Filed: Jul. 6, 1977

[51] Int. Cl.[2] ..... B65D 5/48; B65D 85/00

[52] U.S. Cl. ..... 229/15; 229/28 R

[58] Field of Search ..... 229/15, 27, 28 R, 28 BC, 229/42

[56] References Cited

U.S. PATENT DOCUMENTS

| | | | |
|---|---|---|---|
| 2,893,426 | 5/1961 | Mueller | 229/28 R |
| 3,073,506 | 1/1963 | Ullger | 229/15 X |
| 3,269,636 | 8/1966 | Holmer | 229/15 |
| 3,380,642 | 4/1968 | Kotowick | 229/15 |
| 3,514,031 | 5/1970 | Burgess | 229/28 R |
| 4,030,659 | 6/1977 | Gardner | 229/28 R X |

*Primary Examiner*—Davis T. Moorhead

*Attorney, Agent, or Firm*—Walter M. Rodgers; Walter A. Rodgers

[57] ABSTRACT

A packaging insert is formed from a unitary blank and comprises a pair of spaced side walls, a pair of end walls with the sides thereof secured respectively to the ends of the side walls, at least one transverse partition foldably joined at one end thereof to one side wall and adhered at the other end thereof to the other side wall, and a pair of auxiliary panels foldably joined to each other and disposed in face contacting relation, and the pair of auxiliary panels being foldably joined respectively to one of the side walls and to one of the end walls.

5 Claims, 5 Drawing Figures

PACKAGING INSERT

Inserts are currently utilized in the packaging of fragile primary packages such as bottles in order to prevent breakage during transport. Often basket style carriers are packaged in combination with loose bottles in a larger package such as a case. Of course the loose bottles are subject to undue breakage unless effective separation is provided. One method of providing the necessary bottle separation is to form a packaging insert from a dimensionally long and quite narrow insert which conforms to the number of loose bottles in the case. This type of insert cannot effectively be cut and glued on existing production machinery.

According to this invention a packaging insert is provided and comprises a pair of spaced side walls, a pair of end walls with the sides thereof secured respectively to the ends of the side walls, at least one transverse partition secured at each end thereof respectively to the side walls and extending therebetween, and a pair of auxiliary panels foldably joined together and disposed in face contacting relation to each other and secured respectively to one of the side walls and to one of the end walls.

For a better understanding of the invention reference may be had to the following detailed description taken in conjunction with the accompanying drawing in which FIG. 1 is a perspective view of a set-up packaging insert constructed according to this invention;

FIG. 3 is an intermediate stage through which the packaging insert is folded and glued to form the complete and collapsed packaging insert shown in FIG. 4; and in which

Figure 2:
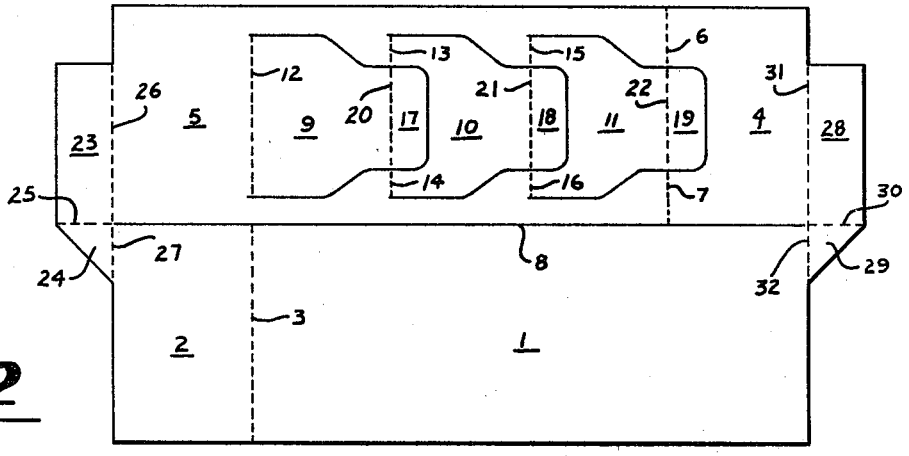
FIG. 2 is a plan view of the blank from which the packaging insert is formed.

As shown in the drawings, the blank includes two sections separated by a longitudinal slit, each section having a side wall and an end wall. More specifically, the numeral 1 designates a side wall of the packaging insert to an end edge of which end wall 2 is foldably joined along fold line 3. Similarly end wall 4 is foldably joined to side wall 5 along fold lines 6 and 7. Side wall 1 and end wall 2 are separated from side wall 5 and end wall 4 by longitudinal slit 8. As is apparent from FIGS. 2 and 3 end walls 2 and 4 are disposed at diagonally opposite corners of the blank.

In order to provide necessary transverse article separation, transverse partitions 9, 10 and 11 are provided. More specifically transverse partition 9 is foldably joined to side wall 5 along fold line 12. Similarly transverse partition 10 is foldably joined to side wall 5 along fold lines 13 and 14. Also transverse partition 11 is foldably joined to side wall 5 along fold lines 15 and 16. Transverse partitions 9, 10 and 11 are respectively provided with anchoring flaps 17, 18 and 19. Anchoring flaps 17, 18 and 19 are foldably joined respectively to transverse partition 9, 10 and 11 along fold lines 20, 21 and 22. Preferably anchoring flaps 17 and 18 are struck from the adjacent transverse partitions 10 and 11 and arranged so that the fold line 20 is aligned with fold lines 13 and 14 similarly fold line 21 is aligned with fold lines 15 and 16.

According to one facet of this invention, auxiliary panels 23 and 24 are provided and are foldably joined together along fold line 25. In addition auxiliary panel 23 is foldably joined to an end edge of side wall 5 along fold line 26 and, similarly, auxiliary panel 24 is foldably joined to a side edge of end wall 2 along fold line 27.

The opposite end of the packaging insert blank is similarly constructed and comprises auxiliary panels 28 and 29 which are foldably joined together along fold line 30. Auxiliary panel 28 is foldably joined to a side edge of end wall 4 along fold line 31 and auxiliary panel 29 is foldably joined to an end edge of side wall 1 along fold line 32. Fold lines 25 and 30 are aligned with longitudinal slit 8.

Figure 1:
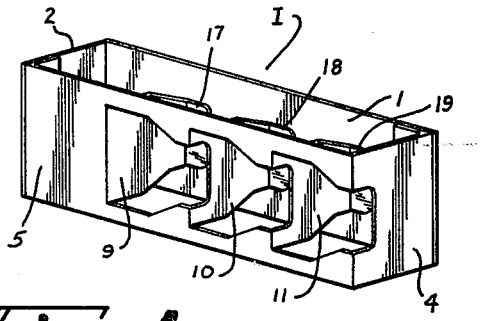
Figure 3:
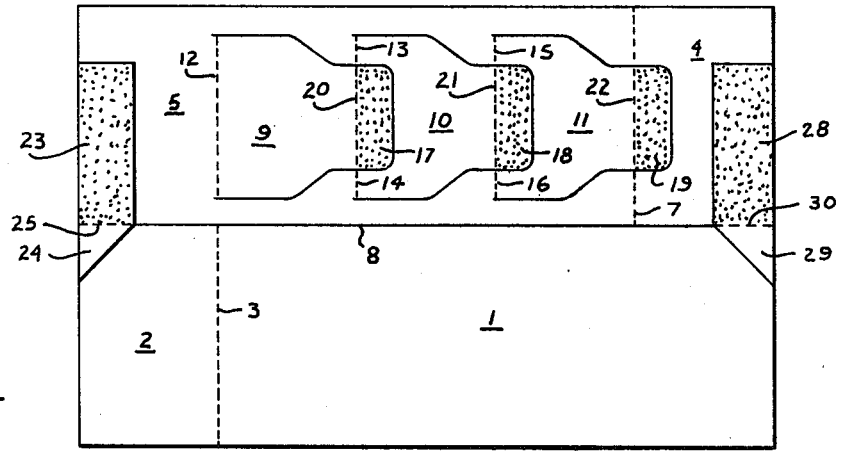

In order to form the packaging insert from the blank shown in FIG. 1, it is necessary initially to fold auxiliary panels 23 and 24 upwardly and to the right respectively along fold lines 26 and 27. Simultaneously auxiliary panels 28 and 29 are lifted and folded toward the left respectively along fold lines 31 and 32. The blank then appears as shown in FIG. 3.

Subsequently an application of glue is made to the blank as shown by stippling in FIG. 3. More specifically glue is applied to anchoring tabs 17, 18 and 19 as well as to auxiliary panels 23 and 28. Thereafter the entire upper half of the blank as shown in FIG. 3 is lifted and folded over along longitudinal slit 8 and fold lines 25 and 30 into the position shown in FIG. 4. By this operation auxiliary panel 23 becomes adhered to auxiliary panel 24 and to end wall 2. In similar fashion auxiliary panel 28 becomes adhered to auxiliary panel 29 and side wall 1. In addition anchoring tabs 17, 18 and 19 are adhered to side wall 1. The blank then appears as shown in FIG. 4 which represents the packaging insert in complete and collapsed condition.

Figure 4:
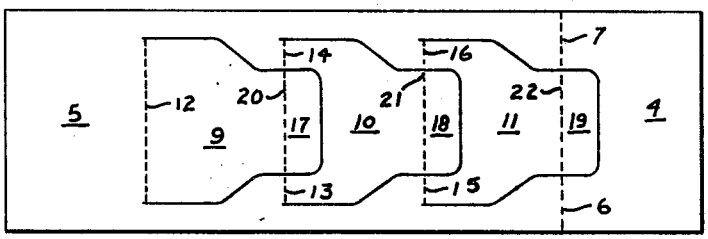

In order to form the packaging insert into a set-up condition as shown in FIG. 1 from the collapsed condition shown in FIG. 4, it is simply necessary to separate side walls 1 and 5 to the point where they are perpendicular to end walls 2 and 4. After this operation the packaging insert appears as shown in FIG. 1 from which it is apparent that the auxiliary panels 23 and 24 are disposed diagonally opposite from auxiliary panels 28 and 29.

Figure 5:
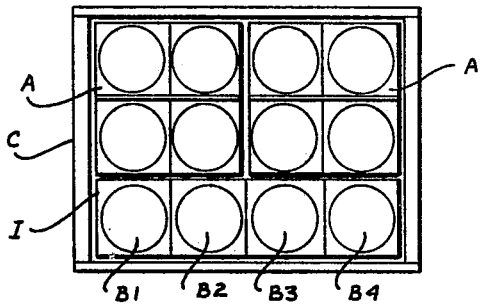
FIG. 5 illustrates one application of this invention.

With reference to FIG. 5, one application of this invention is shown wherein a pair of conventional four cell basket style article carriers A are packaged in a case C. Therefore without proper protection loose bottles B1, B2, B3 and B4 are prone to breakage during transit. In order to provide proper bottle separation, according to one aspect of this invention, a four cell packaging insert I formed according to this invention is placed around loose bottles B1, B2, B3 and B4 as shown in FIG. 5. In addition it can be seen that this invention can be adapted to many packaging combinations to provide proper protection for various numbers of loose bottles.

The embodiments of the invention in which an exclusive property or privilege is claimed are defined as follows:

1. A packaging insert comprising a pair of spaced side walls, a pair of end walls with the sides thereof secured respectively to the ends of said side walls, a transverse partition secured at each end thereof respectively to said side walls and extending therebetween, and a pair of auxiliary panels disposed in face contacting relation to each other and joined respectively to one end of one of said side walls and to the adjacent end wall, said pair of auxiliary panels being foldably joined to each other.

2. A packaging insert according to claim 1 wherein one of said auxiliary panels is of triangular configuration.

3. A packaging insert according to claim 1 wherein one panel of said pair of auxiliary panels is foldably joined to said one of said side walls and wherein the other panel of said pair of said auxiliary panels is foldably joined to said one of said adjacent end wall.

4. A packaging insert according to claim 3 wherein a second pair of auxiliary panels are foldably joined in face contacting relation to each other and are foldably joined respectively to the other of said side walls and to the other of said end walls.

5. A packaging insert according to claim 4 wherein one panel of said second pair of auxiliary panels is foldably joined to said outer side wall and wherein the other panel of said second pair of auxiliary panels is foldably joined to said other of said end walls.

* * * * *